US011491527B2

(12) United States Patent
Yang et al.

(10) Patent No.: US 11,491,527 B2
(45) Date of Patent: Nov. 8, 2022

(54) WHEEL SPINNING DIE AND DIE RELEASING DEVICE

(71) Applicant: CITIC Dicastal Co., Ltd., Qinhuangdao (CN)

(72) Inventors: Jinling Yang, Qinhuangdao (CN); Lijun Zhang, Qinhuangdao (CN); Yukun Yang, Qinhuangdao (CN); Zhen Wang, Qinhuangdao (CN); Li Yang, Qinhuangdao (CN)

(73) Assignee: CITIC Dicastal Co., Ltd., Qinhuangdao (CN)

( * ) Notice: Subject to any disclaimer, the term of this patent is extended or adjusted under 35 U.S.C. 154(b) by 235 days.

(21) Appl. No.: 16/666,350

(22) Filed: Oct. 28, 2019

(65) Prior Publication Data

US 2020/0360980 A1 Nov. 19, 2020

(30) Foreign Application Priority Data

May 16, 2019 (CN) ..... 201910405709.2

(51) Int. Cl.
*B21D 22/16* (2006.01)
*B21D 53/30* (2006.01)
(Continued)

(52) U.S. Cl.
CPC ..... *B21D 22/16* (2013.01); *B21D 22/14* (2013.01); *B21D 37/10* (2013.01); *B21D 45/04* (2013.01); *B21D 53/30* (2013.01)

(58) Field of Classification Search
CPC ..... B21D 22/14; B21D 22/16; B21D 22/18; B21D 45/02; B21D 45/06; B21D 37/10;
(Continued)

(56) References Cited

U.S. PATENT DOCUMENTS 4,170,888 A * 10/1979 Golata ..... B21D 22/16 279/131
5,212,866 A * 5/1993 Wenzel ..... B21D 22/16 29/894.354
(Continued)

FOREIGN PATENT DOCUMENTS

JP 56-95438 A * 1/1981 ..... B21D 53/30
JP 60-145231 A * 7/1985 ..... B21D 22/18
(Continued)

OTHER PUBLICATIONS

Translation; WO 2017/142123 A1; Choi et al. Aug. 2017.*

*Primary Examiner* — Edward T Tolan
(74) *Attorney, Agent, or Firm* — IPRO, PLLC

(57) ABSTRACT

Provided is a wheel spinning die wherein the plurality of identical slide blocks are connected end to end to form a circular ring, and the slide blocks are inserted into an annular groove between the side wall of a circular groove at the upper end of the lower die and the central connecting block; during spinning, each arc flange is clamped at the joint of an outer wheel lip and a rim under a spoke; and during die releasing, the slide blocks can move up and down together with the vertical movement of a wheel blank, so that the problem of releasing of a reverse draft die at the joint of the cold spinning wheel rim and the outer wheel lip can be solved, wheel damage caused by die releasing can be eliminated, and the yield and production efficiency of wheels are improved.

9 Claims, 6 Drawing Sheets

(51) Int. Cl.

| | |
|---|---|
| ***B21D 37/10*** | (2006.01) |
| ***B21D 22/14*** | (2006.01) |
| ***B21D 45/04*** | (2006.01) |

(58) Field of Classification Search
CPC ..... B21D 53/30; B21D 45/04; B21D 53/268; Y10T 29/49531
See application file for complete search history.

(56) References Cited

U.S. PATENT DOCUMENTS

| | | | | |
|---|---|---|---|---|
| 5,740,609 | A * | 4/1998 | Jurus | B21D 22/16 29/894.324 |
| 7,806,679 | B2 * | 10/2010 | Murata | B21D 22/16 425/374 |
| 2008/0028741 | A1 * | 2/2008 | Ishida | B21D 22/14 57/281 |
| 2014/0007638 | A1 * | 1/2014 | Abbassian | B21D 45/02 72/206 |
| 2019/0291159 | A1 * | 9/2019 | Nillies | B21D 22/16 |

FOREIGN PATENT DOCUMENTS

| | | | | |
|---|---|---|---|---|
| WO | 2017/142123 | A1 * | 8/2017 | B21D 53/30 |
| WO | 2018/224027 | A1 * | 12/2018 | B21D 31/005 |
| WO | 2019/131849 | A1 * | 7/2019 | B21D 53/30 |

* cited by examiner

WHEEL SPINNING DIE AND DIE RELEASING DEVICE

FIELD

The disclosure relates to the technical field of spinning dies, in particular to a wheel spinning die and a die releasing device.

BACKGROUND

A traditional cold spinning die for wheel hubs and rims is in solid contact with a wheel rim in the cold spinning process. There is a reverse draft die at the joint between the cold spinning die and the rim and outer wheel lip of a wheel blank. The edge of a wheel die extends into the interior of the wheel blank, causing difficulty in die releasing. Forced die releasing tends to cause damage to the die and the wheel blank; in addition, the front surface of the wheel blank can be easily deformed when the die is removed, thus affecting the production efficiency and yield of wheels.

SUMMARY

The embodiment of the disclosure provides a wheel spinning die and a die releasing device, which can solve the problem of releasing of a reverse draft die at the joint of a cold spinning wheel rim and an outer wheel lip, the problem that die releasing cannot be realized when a central connecting block is used to eject a wheel blank in common practice, and the problem that the front surface of the wheel blank may be deformed when the central connecting block is used to eject the wheel blank as an ejector rod, thus eliminating wheel damage caused by die releasing, and improving the yield and production efficiency of wheels.

In order to achieve the above purpose, the disclosure provides the following technical solution: in a first aspect, a wheel spinning die is provided, comprising an upper die, a connecting sleeve, slide blocks, a lower die, and a central connecting block, wherein the connecting sleeve is fixed on an upper main shaft of a spinning machine, the connecting sleeve is fixedly connected with the upper surface of the upper die, and the lower die is fixed on the upper end of a lower main shaft of the spinning machine; a circular groove is formed in the middle of the lower die, and a cylindrical central connecting block is fixed in the middle of the circular groove; the diameter of the central connecting block is smaller than the diameter of the circular groove, and the diameter of the central connecting block is larger than the flange diameter of a wheel; the upper surface of each slide block, the side wall of the side, facing a rim, of each slide block, the upper surface of the central connecting block and the bottom surface of the upper die are adapted to the shape of a wheel blank, and the upper end edge of the side, facing the rim, of each slide block is provided with an arc flange; a plurality of identical slide blocks are uniformly distributed in the circumferential space between the central connecting block and the circular groove, and the plurality of identical slide blocks are connected end to end to form a circular ring; the bottom of each slide block is provided with arc grooves with right-angled longitudinal sections on the side facing the center of the wheel blank and the side facing the rim of the wheel blank; the slide blocks are inserted into an annular groove between the side wall of the circular groove at the upper end of the lower die and the central connecting block, and the side wall of the circular groove and the central connecting block can be respectively clamped in the arc grooves on both sides of the bottom of each slide block; during spinning, each arc flange is clamped at the joint of an outer wheel lip and the rim under a spoke; and during die releasing, the slide blocks can move up and down together with the vertical movement of the wheel blank. wherein the slide blocks can be detachably fixed under a spoke by means of the interaction force among the slide blocks and the interaction between each slide block and the wheel blank, and the slide blocks can be manually detached from the bottom surface of the spoke of the wheel blank, so that the slide blocks can move up and down along with the wheel blank, die releasing difficulty caused by the existence of a reverse draft die is avoided, and meanwhile, the structural design of the die enables a fixing structure to be simple, so that spinning uncontrollability caused by the design of other fixing parts is avoided.

Preferably, wherein the number of the slide blocks is 4, 5, 6, 8, 9, 10 or 12. The number of the slide blocks is preferably such that the circumference of the ring is divided into several equal areas.

In some embodiments, wherein the bottom surface of each slide block is provided with a downward step, the bottom surface of the circular groove is provided with an upward step, and during spinning, the step on the bottom surface of each slide block and the step on the bottom surface of the circular groove fit together. and such a fitting structural design avoids relative movement of the slide blocks and the lower die, thereby improving the forging accuracy and forging yield.

In some embodiments, wherein the middle of the lower die is provided with a circular through hole, the central connecting block is divided into an upper part and a lower part, the diameter of the upper part is larger than that of the circular through hole, and the diameter of the lower part is slightly smaller than that of the circular through hole; and the upper part of the central connecting block is fixed in the circular groove of the lower die, and the lower part of the central connecting block extends into the circular through hole in the middle of the lower die. and the design of the central connecting block extending into the lower die makes the position of the central connecting block more stable and less prone to shake, thus improving the forging accuracy and forging yield.

Further, wherein the wheel spinning die further comprises an upper tail top, a circular blind hole is formed in the middle of the central connecting block, the upper tail top is fixed in the upper die, and the lower end of the upper tail top can be inserted into the circular blind hole of the central connecting block after passing through a central hole of the wheel blank along with the downward pressing of the upper main shaft of the spinning machine. The circular blind hole is used to guide the upper tail top, which makes it difficult for the upper and lower dies to shift in the pressing process, thus improving the forging accuracy and forging yield.

Further, wherein the longitudinal section of the upper tail top is T-shaped, the middle position of the upper surface of the upper die is provided with a groove adapted to the shape of the upper part of the upper tail top, and the middle position of the groove of the upper die is provided with a through hole; and the upper tail top is fixed in the groove between the connecting sleeve and the upper die, the lower part of the upper tail top passes through a through hole of the upper die, the middle of the connecting sleeve is hollow, and the upper main shaft of the spinning machine passes through the connecting sleeve and is close to the upper surface of the upper tail top. the position of the upper tail top is fixed by means of the connecting sleeve, meanwhile, the upper main shaft of the spinning machine can be directly pressed onto the upper tail top, and the upper tail top transmits the pressure to the upper die, so that the upper die is stressed evenly, and the structure is firmer, so that fixation loosening caused by repeated pressing is prevented.

In another aspect, a die releasing device for a wheel spinning die is provided, comprising the wheel spinning die according to any one of said wheel spinning die, and further comprising lifting components and pallets, wherein there are a plurality of lifting components, the lifting components are uniformly fixed on a spinning machine table along the circumference of the lower die, the upper end of each lifting component is fixed to the corresponding pallet, and the pallets move upwards along with the lifting components, so that the wheel blank can be lifted so as to be separated from the lower die. The lifting component can be an air cylinder, a hydraulic cylinder or an electric cylinder, the lifting components push the pallets to move up, the pallets push the wheel blank to be separated from the lower die, and then the slide blocks are unloaded to complete die releasing; and the device can solve the problem of releasing of a reverse draft die at the joint of a cold spinning wheel rim and an outer wheel lip, and the problems that die releasing cannot be realized and the front surface of the wheel blank may be deformed when the central connecting block is used to eject the wheel blank in common practice, thus eliminating wheel damage caused by die releasing, and improving the yield and production efficiency of wheels.

Further, wherein the pallets form an integral ring or are segmented arc plates with the same number as the lifting components. The pallets can be designed to be integral or segmented.

Further, comprising a spinning machine main shaft sleeve, wherein the lower main shaft of the spinning machine is sleeved with the spinning machine main shaft sleeve, and the spinning machine main shaft sleeve is fixed on a frame of the spinning machine. The spinning machine main shaft sleeve plays a guiding role, so that the lower main shaft of the spinning machine is not prone to shake, thus improving the forging accuracy and forging yield.

Compared with the prior art, the disclosure has the following beneficial effects:

The disclosure provides a wheel spinning die and a die releasing device, wherein a plurality of identical slide blocks are connected end to end to form a circular ring, the bottom of each slide block is provided with arc grooves with right-angled longitudinal sections on the side facing the center of the wheel blank and the side facing the rim of the wheel blank, and the slide blocks are inserted into the annular groove between the side wall of the circular groove at the upper end of the lower die and the central connecting block; during spinning, each arc flange is clamped at the joint of the outer wheel lip and the rim under the spoke; and during die releasing, the slide blocks can move up and down together with the vertical movement of the wheel blank, so that the problem of releasing of a reverse draft die at the joint of the cold spinning wheel rim and the outer wheel lip can be solved, wheel damage caused by die releasing can be eliminated, and the yield and production efficiency of wheels are improved. The die releasing device adopts the lifting components and the pallets to lift the wheel blank, and the pallets are used to lift the wheel blank out of the lower die, thus solving the problems that die releasing cannot be realized when the central connecting block is used to eject the wheel blank in common practice, and the front surface of the wheel blank may be deformed when the central connecting block is used to eject the wheel blank as an ejector rod. The device is reasonable in design, avoids wheel damage caused by die releasing, and improves the yield and production efficiency of wheels.

BRIEF DESCRIPTION OF THE DRAWINGS

In order to more clearly explain the technical solution in the embodiments of the application, drawings which require to be used in description of the embodiments are simply introduced below, obviously, the drawings in description below are some embodiments of the application, and those having ordinary skill in the art can further acquire other drawings without creative efforts according to those drawings.

wherein 1—upper die, 2—connecting sleeve, 3—connecting bolt, 4—slide block, 5—lower die, 6—central connecting block, 7—upper tail top, 8—lifting component, 9—pallet, 10—wheel blank, 11—spinning machine table, 12—spinning machine main shaft sleeve, 13—lower main shaft of spinning machine, and 14—upper main shaft of spinning machine.

DETAILED DESCRIPTION

The technical solution in the embodiments of the application is clearly and completely described in combination with drawings of the embodiments of the application below, and obviously, the described embodiments are part of embodiments of the application rather than all embodiments. Based on the embodiments of the application, all the other embodiments obtained by those having ordinary skill in the art without any creative works are within the protection scope of the application.

The terms 'first', 'second', 'third', 'fourth' and the like in the specification and in the claims of the application are used for distinguishing different objects but not for describing a specific sequence. Furthermore, the terms 'comprise' and 'have' as well as their any variations are intended to cover a non-exclusive inclusion. For example, a process, method, system, product or equipment comprising a series of steps or units does not limit steps or units which have been listed, but selectively further comprises steps or units which are not listed, or selectively further comprises other inherent steps or units for the process, method, product or equipment.

Reference in the specification to 'embodiments' of the application means that a particular feature, structure or characteristic described in connection with the embodiments is included in at least one embodiment of the application. The appearances of the phrase 'the embodiments' in various places in the specification are not necessarily all referring to the same embodiment, nor are separate or alternative embodiments necessarily mutually exclusive of other embodiments. It will be explicitly and implicitly understood by those skilled in the art that the embodiments described in the application can be combined to other embodiments.

In order to further understand the content, features and functions of the disclosure, the following embodiments are given and illustrated with the attached drawings as follows.

Embodiment 1

Figure 1:
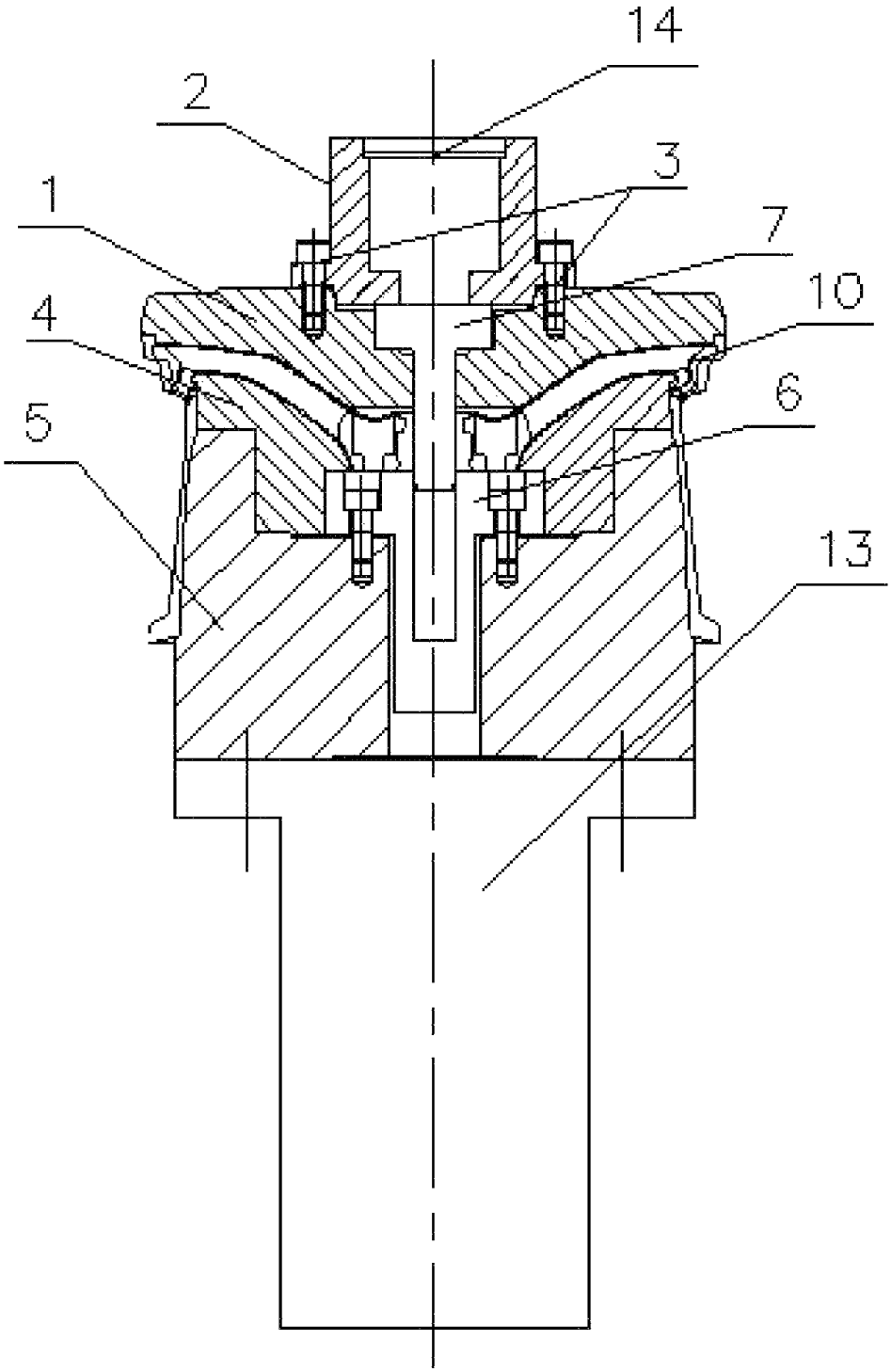
FIG. 1 is a schematic structural view of a wheel spinning die of the present disclosure.
Figure 2:
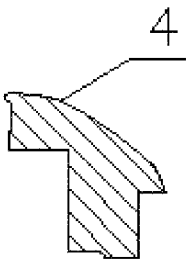
FIG. 2 is a front view of a slide block of a wheel spinning die of the present disclosure.
Figure 3:
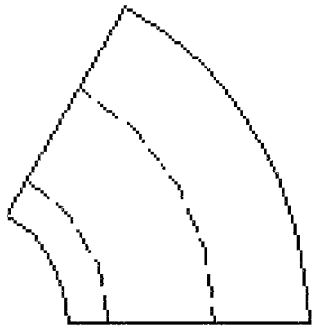
FIG. 3 is a top view of a slide block of a wheel spinning die of the present disclosure.
Figure 4:
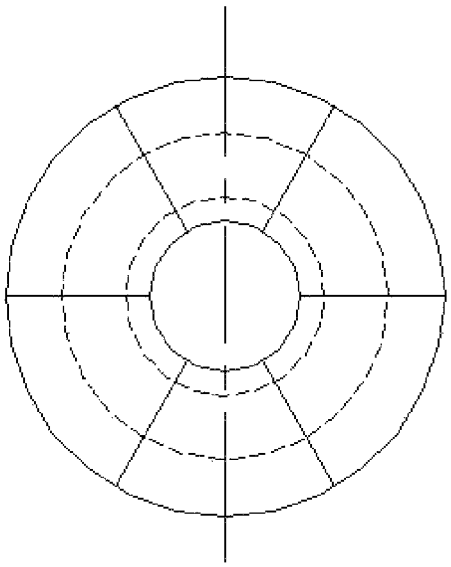
FIG. 4 is an assembly schematic of a slide block of a wheel spinning die of the present disclosure.

Embodiment 1 of the present disclosure will be described below with reference to FIGS. 1-4 (wherein dotted lines are auxiliary lines and not visible in the real object): a wheel spinning die comprises an upper die 1, a connecting sleeve 2, connecting bolts 3, slide blocks 4, a lower die 5, a central connecting block 6 and an upper tail top 7; the connecting sleeve 2 is fixed on an upper main shaft 14 of a spinning machine, the connecting sleeve 2 is fixedly connected with the upper surface of the upper die 1, and the connecting sleeve 2 is connected with the upper die 1 through the connecting bolts 3; the lower die 5 is fixed on the upper end of a lower main shaft 13 of the spinning machine through the connecting bolts 3, the lower main shaft 13 of the spinning machine drives the lower die 5 to move and rotate, a circular groove is formed in the middle of the lower die 5, and the cylindrical central connecting block 6 is fixed in the middle of the circular groove through the connecting bolts 3; and the diameter of the central connecting block 6 is smaller than the diameter of the circular groove, and the diameter of the central connecting block 6 is larger than the flange diameter of a wheel. The upper surface of each slide block 4, the side wall of the side, facing a rim, of each slide block 4, the upper surface of the central connecting block 6 and the bottom surface of the upper die 1 are adapted to the shape of a wheel blank 10, and the upper end edge of the side, facing the rim, of each slide block 4 is provided with an arc flange. A plurality of identical slide blocks 4 are uniformly distributed in the circumferential space between the central connecting block 6 and the circular groove, and the plurality of identical slide blocks 4 are connected end to end to form a circular ring. In the present embodiment, as shown in FIG. 4, the number of the slide blocks 4 is 6; the bottom of each slide block 4 is provided with arc grooves with right-angled longitudinal sections on the side facing the center of the wheel blank 10 and the side facing the rim of the wheel blank 10; and the slide blocks 4 are inserted into an annular groove between the side wall of the circular groove at the upper end of the lower die 5 and the central connecting block 6, and the side wall of the circular groove and the central connecting block 6 can be respectively clamped in the arc grooves on both sides of the bottom of each slide block 4. The bottom surface of each slide block 4 is provided with a downward step, and the bottom surface of the circular groove is provided with an upward step.

The middle of the lower die 5 is provided with a circular through hole, the central connecting block 6 is divided into an upper part and a lower part, the diameter of the upper part is larger than that of the circular through hole, and the diameter of the lower part is slightly smaller than that of the circular through hole; and the upper part of the central connecting block 6 is fixed in the circular groove of the lower die 5, and the lower part of the central connecting block 6 extends into the circular through hole in the middle of the lower die 5. A circular blind hole is formed in the middle of the central connecting block 6, the upper tail top 7 is fixed in the upper die 1, and the lower end of the upper tail top 7 can be inserted into the circular blind hole of the central connecting block 6 after passing through a central hole of the wheel blank 10 along with the downward pressing of the upper main shaft 14 of the spinning machine. The longitudinal section of the upper tail top 7 is T-shaped, the middle position of the upper surface of the upper die 1 is provided with a groove adapted to the shape of the upper part of the upper tail top 7, and the middle position of the groove of the upper die 1 is provided with a through hole; and the upper tail top 7 is fixed in the groove between the connecting sleeve 2 and the upper die 1, the lower part of the upper tail top 7 passes through a through hole of the upper die 1, the middle of the connecting sleeve 2 is hollow, and the upper main shaft 14 of the spinning machine passes through the connecting sleeve 2 and is close to the upper surface of the upper tail top 7. The slide blocks 4 can be detachably fixed under a spoke by means of the interaction force between the slide blocks 4 and the interaction between each slide block 4 and the wheel blank 10, and the slide blocks 4 can be manually detached from the bottom surface of the spoke of the wheel blank 10, so that the slide blocks 4 can move up and down along with the wheel blank 10, die releasing difficulty caused by the existence of a reverse draft die is avoided, and meanwhile, the structural design of the die enables a fixing structure to be simple, so that spinning uncontrollability caused by the design of other fixing parts is avoided.

During spinning, the side wall of the circular groove and the central connecting block 6 can be respectively clamped in the arc grooves on both sides of the bottom of each slide block 4, the step on the bottom surface of each slide block 4 and the step on the bottom surface of the circular groove fit together, and the arc flange of each slide block 4 is clamped at the joint of an outer wheel lip and the rim under the spoke; and six identical slide blocks 4 are uniformly distributed in the circumferential space between the central connecting block 6 and the circular groove, and the six identical slide blocks 4 are connected end to end to form a circular ring, as shown in FIG. 4, and the lower end of the upper tail top 7 is inserted into the circular blind hole of the central connecting block 6 after passing through the central hole of the wheel blank 10. During die releasing, even when the wheel blank 10 is detached from the lower die 5, the slide blocks 4 can move up and down along with the vertical movement of the wheel blank 10.

In other embodiments, the number of the slide blocks 4 is 4, 5, 8, 9, 10 or 12, and the plurality of slide blocks 4 uniformly distributed in the circumferential direction are inserted into the groove in the upper end of the lower die 5.

Embodiment 2

A die releasing device for a wheel spinning die comprises the wheel spinning die in Embodiment 1, and further comprises lifting components 8, pallets 9 and a spinning machine main shaft sleeve. There are a plurality of lifting components 8, the lifting components 8 are uniformly fixed on a spinning machine table 11 along the circumference of the lower die 5, and the lifting component 8 can be an air cylinder, a hydraulic cylinder or an electric cylinder; and the lower end of each lifting component 8 is fixed on the spinning machine table 11 through the corresponding connecting bolt 3, the upper end of each lifting component 8 is fixed to the corresponding pallet 9 through the corresponding connecting bolt 3, and the pallets 9 move upwards along with the lifting components 8, so that the wheel blank 10 can be lifted for die releasing, making the wheel blank 10 separated from the lower die 5. The pallets 9 form an integral ring or are segmented arc plates with the same number as the lifting components 8. The lower main shaft 13 of the spinning machine is sleeved with the spinning machine main shaft sleeve, and the spinning machine main shaft sleeve is fixed on a frame of the spinning machine.

Figure 5:
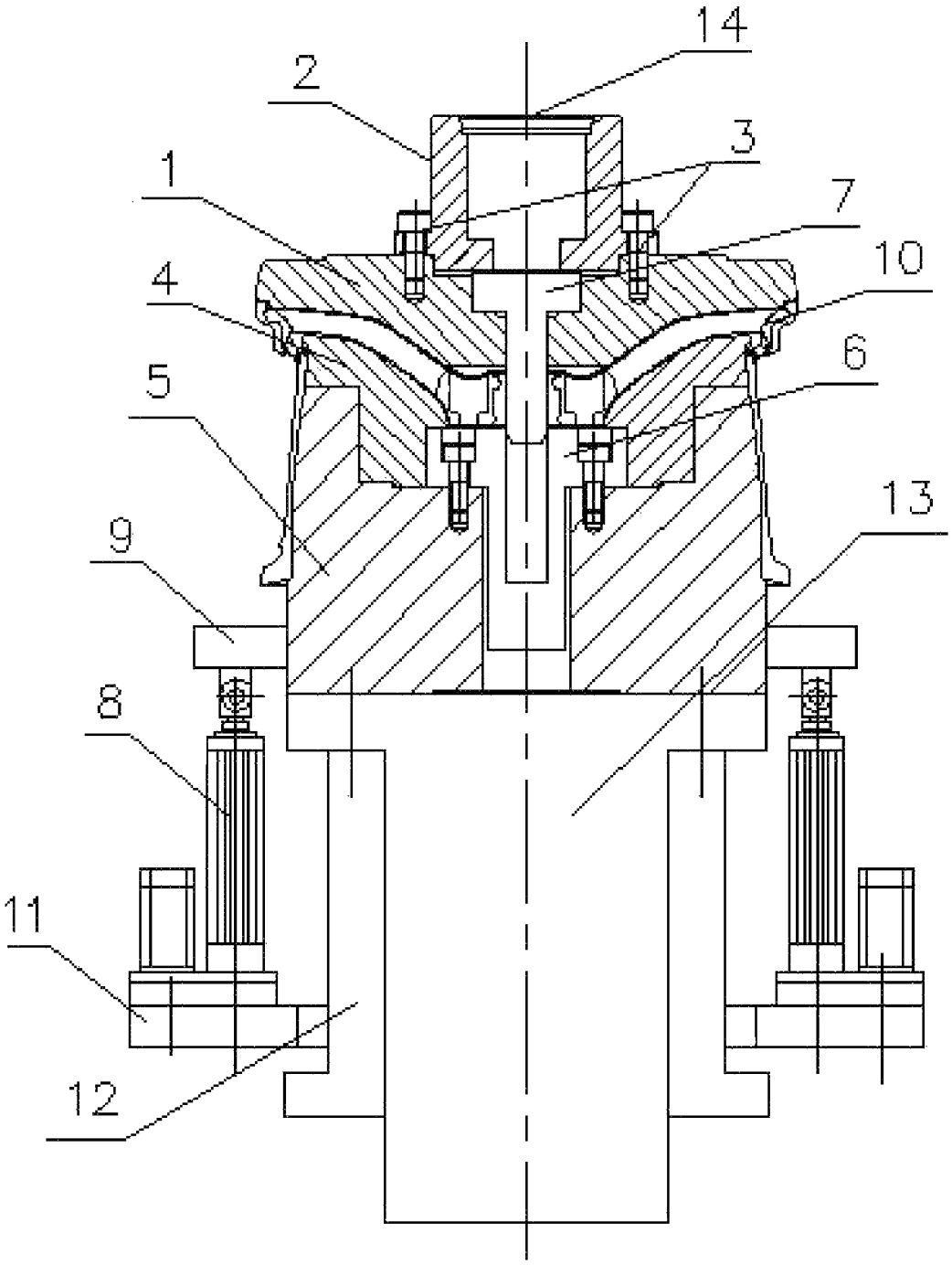
FIG. 5 is a schematic structural view of a die releasing device for a wheel spinning die of the present disclosure.
Figure 6:
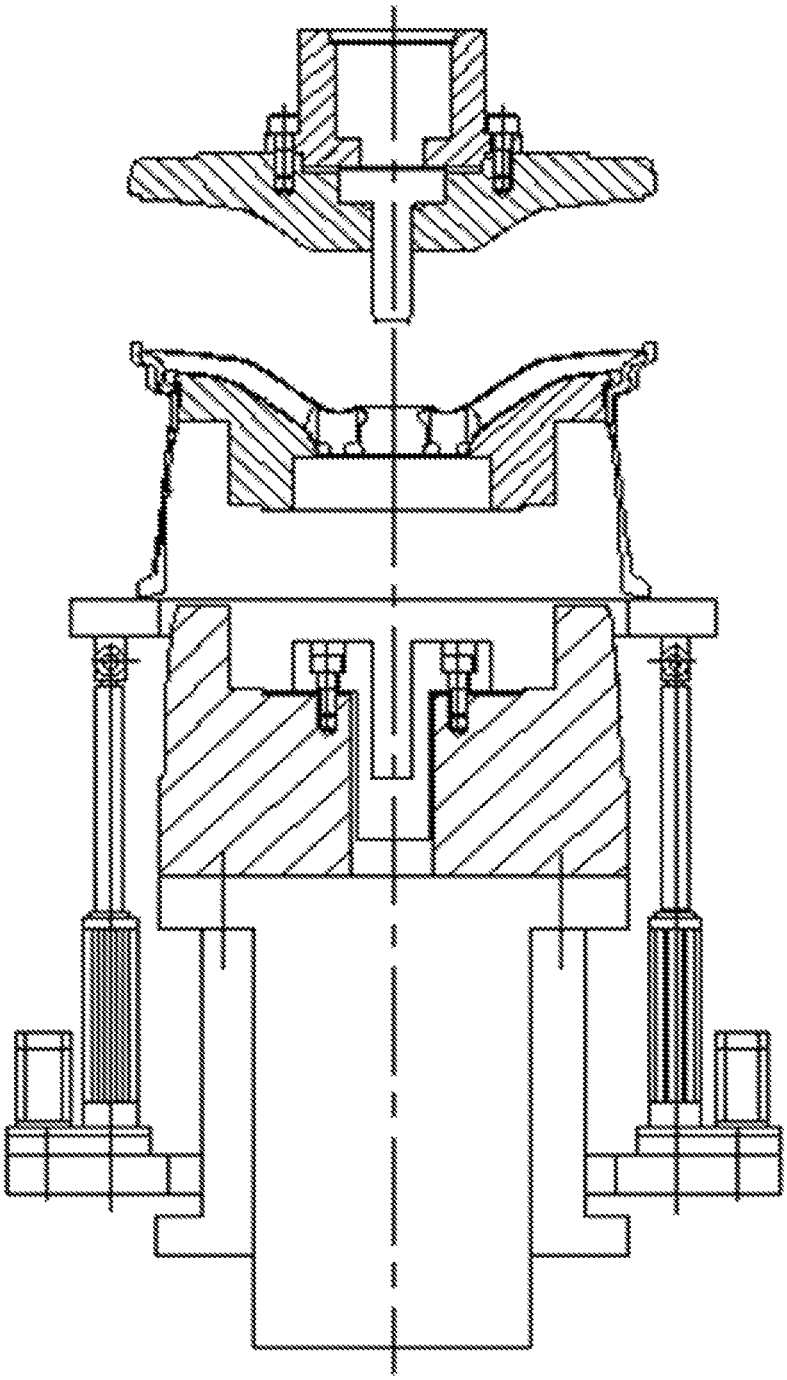
FIG. 6 is a schematic showing a die releasing state of a die releasing device for a wheel spinning die of the present disclosure.

In operation, before spinning starts, under the drive of the upper main shaft 14 of the spinning machine, the connecting sleeve 2, the upper tail top 7 and the upper die 1 are lifted, and six slide blocks 4 uniformly distributed in the circumferential direction are inserted into the groove in the upper end of the lower die 5, as shown in FIG. 5. Then the heavy-duty cold spinning wheel blank 10 is placed on the slide blocks 4 and the lower die 5 with a manipulator, and then under the drive of the upper main shaft 14 of the spinning machine, the connecting sleeve 2, the upper tail top 7 and the upper die 1 fall down to compact the heavy-duty cold spinning wheel blank 10; and the upper tail top 7 is inserted into the central hole of the heavy-duty cold spinning wheel blank 10, then the lower main shaft 13 of the spinning machine rotates under the drive of a motor, a spinning roller starts spinning the heavy-duty cold spinning wheel blank 10 till spin forming is realized, and the lower main shaft 13 of the spinning machine and the lower die 5 stop rotating. The pallets 9 lift the spin-formed heavy-duty cold spinning wheel blank 10 out of the die under the support of the lifting components 8, at the same time, the six slide blocks 4 are manually removed from the heavy-duty cold spinning wheel blank 10 along with the wheel blank 10, so that the slide blocks 4 are removed from a cavity of the cold spinning wheel blank 10, and then the pallets 9 fall down under the drive of the lifting components 8. The six slide blocks 4 uniformly distributed in the circumferential direction are re-inserted into the groove in the upper end of the lower die 5 for spinning and die releasing of the next cold spinning wheel blank 10.

To sum up, the disclosure provides a wheel spinning die and a die releasing device, wherein a plurality of identical slide blocks are connected end to end to form a circular ring, the bottom of each slide block is provided with arc grooves with right-angled longitudinal sections on the side facing the center of the wheel blank and the side facing the rim of the wheel blank, and the slide blocks are inserted into the annular groove between the side wall of the circular groove at the upper end of the lower die and the central connecting block; during spinning, each arc flange is clamped at the joint of the outer wheel lip and the rim under the spoke; and during die releasing, the slide blocks can move up and down together with the vertical movement of the wheel blank, so that the problem of releasing of a reverse draft die at the joint of the cold spinning wheel rim and the outer wheel lip can be solved, wheel damage caused by die releasing can be eliminated, and the yield and production efficiency of wheels are improved. The die releasing device adopts the lifting components and the pallets to lift the wheel blank, and the pallets are used to lift the wheel blank out of the lower die, thus solving the problems that die releasing cannot be realized and the front surface of the wheel blank may be deformed when the central connecting block is used to eject the wheel blank in common practice. The device is reasonable in design, avoids wheel damage caused by die releasing, and improves the yield and production efficiency of wheels.

The embodiments of the application are described in detail above, particular examples are used herein to explain the principle and embodiments of the application, and the above description of the embodiments is only used to help understanding the methods and core concept of the application; and meanwhile, for those having ordinary skill in the art, according to the idea of the application, there will be changes in the specific implementation mode and application scope, in conclusion, the contents of the specification shall not be construed as a limitation of the application.

What is claimed is:

1. An apparatus comprising an upper die, a connecting sleeve, slide blocks, a lower die, a central connecting block, and an upper tail top, wherein the connecting sleeve is fixed on an upper main shaft of a spinning machine, the connecting sleeve is fixedly connected with an upper surface of the upper die, and the lower die is fixed on an upper end of a lower main shaft of the spinning machine; a circular groove is formed in middle of the lower die, and a cylindrical central connecting block is fixed in the middle of the circular groove; a diameter of the central connecting block is smaller than a diameter of the circular groove, and the diameter of the central connecting block is larger than a diameter of a portion of a wheel blank contacting the central connecting block; an upper surface of each slide block, a side wall of the side, facing a rim, of each slide block, an upper surface of the central connecting block and bottom surface of the upper die are adapted to shape of the wheel blank, and an upper end edge of the side, facing the rim, of each slide block is provided with an arc flange;

a plurality of identical slide blocks are uniformly distributed in a circumferential space between the central connecting block and the circular groove, and the plurality of identical slide blocks are connected end to end to form a circular ring; bottom of each slide block is provided with arc grooves with right-angled longitudinal sections on a side facing the center of the wheel blank and a side facing the rim of the wheel blank; the slide blocks are inserted into an annular groove between a side wall of the circular groove at the upper end of the lower die and the central connecting block, and the side wall of the circular groove and the central connecting block can be respectively clamped in the arc grooves on both sides of the bottom of each slide block; during spinning, each arc flange is clamped at a joint of an outer wheel lip and a rim under a spoke; and during die releasing, the slide blocks can move up and down together with vertical movement of the wheel blank;

a circular blind hole is formed in middle of the central connecting block, the upper tail top is fixed in the upper die, and a lower end of the upper tail top can be inserted into the circular blind hole of the central connecting block after passing through a central hole of the wheel blank along with the downward pressing of the upper main shaft of the spinning machine.

2. The apparatus according to claim 1, wherein the number of the slide blocks is 4, 5, 6, 8, 9, 10 or 12.

3. The apparatus according to claim 1, wherein a bottom surface of each slide block is provided with a downward step, a bottom surface of the circular groove is provided with an upward step, and during spinning, a step on the bottom surface of each slide block and a step on the bottom surface of the circular groove fit together.

4. The apparatus according to claim 1, wherein middle of the lower die is provided with a circular through hole, the central connecting block is divided into an upper part and a lower part, a diameter of the upper part is larger than that of the circular through hole, and a diameter of the lower part is slightly smaller than that of the circular through hole; and an upper part of the central connecting block is fixed in the circular groove of the lower die, and a lower part of the central connecting block extends into the circular through hole in middle of the lower die.

5. The apparatus according to claim 1, wherein a longitudinal section of the upper tail top is T-shaped, middle position of the upper surface of the upper die is provided with a groove adapted to shape of the upper part of the upper tail top, and middle position of the groove of the upper die is provided with a through hole; and the upper tail top is fixed in the groove between the connecting sleeve and the upper die, a lower part of the upper tail top passes through a through hole of the upper die, middle of the connecting sleeve is hollow, and the upper main shaft of the spinning machine passes through the connecting sleeve and is close to the upper surface of the upper tail top.

6. The apparatus according to claim 1, further comprising lifting components and pallets, wherein there are a plurality of lifting components, the lifting components are uniformly fixed on a spinning machine table along the circumference of the lower die, the upper end of each lifting component is fixed to the corresponding pallet, and the pallets move upwards along with the lifting components, so that the wheel blank can be lifted so as to be separated from the lower die.

7. The apparatus according to claim 6, wherein the pallets form an integral ring or are segmented arc plates with the same number as the lifting components.

8. The apparatus according to claim 6, further comprising a spinning machine main shaft sleeve, wherein the lower main shaft of the spinning machine is sleeved with the spinning machine main shaft sleeve, and the spinning machine main shaft sleeve is fixed on a frame of the spinning machine.

9. The apparatus according to claim 7, further comprising a spinning machine main shaft sleeve, wherein the lower main shaft of the spinning machine is sleeved with the spinning machine main shaft sleeve, and the spinning machine main shaft sleeve is fixed on a frame of the spinning machine.

* * * * *